US009402129B2

(12) United States Patent
Wang

(10) Patent No.: US 9,402,129 B2
(45) Date of Patent: Jul. 26, 2016

(54) AUDIO CONTROL METHOD AND AUDIO PLAYER USING AUDIO CONTROL METHOD

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Yin-Zhan Wang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 563 days.

(21) Appl. No.: 13/860,280

(22) Filed: Apr. 10, 2013

(65) Prior Publication Data

US 2013/0272544 A1 Oct. 17, 2013

(30) Foreign Application Priority Data

Apr. 16, 2012 (CN) ..... 2012 1 0109802

(51) Int. Cl.

| | |
|---|---|
| ***H04R 3/00*** | (2006.01) |
| ***H04R 5/033*** | (2006.01) |
| ***H04R 5/04*** | (2006.01) |
| ***H04R 29/00*** | (2006.01) |

(52) U.S. Cl.

CPC *H04R 3/00* (2013.01); *H04R 5/033* (2013.01); *H04R 5/04* (2013.01); *H04R 29/001* (2013.01); *H04R 2420/05* (2013.01); *H04R 2430/01* (2013.01)

(58) Field of Classification Search

CPC ..... H04R 3/00; H04R 5/033; H04R 29/001; H04R 5/04; H04R 2430/01; H04R 2420/05; H04R 1/1041; H03G 3/20

USPC ..... 381/1, 2, 10–12, 17, 303, 77, 85

See application file for complete search history.

(56) References Cited

U.S. PATENT DOCUMENTS

2010/0020982 A1* 1/2010 Brown ..... H03G 3/20 381/74

* cited by examiner

*Primary Examiner* — David Ton

(74) *Attorney, Agent, or Firm* — Novak Druce Connolly Bove + Quigg LLP

(57) ABSTRACT

An audio control method of an audio player, the audio player includes an audio playing unit having a first channel and a second channel, and an audio control system executed by a processor of the audio player. The audio control system includes an audio playing module, a detection module and a channel adjustment module. The audio playing module plays an audio file and outputs audio signals of the audio file through the audio playing unit, the audio signals have a first channel signals and a second channel signals. The detection module detects whether the first channel signals and the second channel signals are normally played. The channel adjustment module combines one of the first and second channel signals to another of the first and second channel signals, to form combination signals, and plays the combination signals through the first or the second channel.

16 Claims, 2 Drawing Sheets

AUDIO CONTROL METHOD AND AUDIO PLAYER USING AUDIO CONTROL METHOD

BACKGROUND

1. Technical Field

The present disclosure relates to audio processing technologies, and particularly to an audio control method and an audio player using the audio control method.

2. Description of Related Art

Audio players, such as an MP3 player, a smart phone, a mobile internet device, or a portable computer, may include a speaker and a headphone to play audio signals. The audio signals may include first channel signals and second channel signals, and the speaker and the headphone may include a first channel and a second channel to output the first and second channel signals, respectively. However, in some particular situations, only one of the first and second channels may be needed to listen to the audio, so that first channel signals or second channel signals may be lost, and acoustical enjoyment may be thus reduced.

Therefore, there is room for improvement in the art.

BRIEF DESCRIPTION OF THE DRAWINGS

The components in the drawing are not drawn to scale, the emphasis instead being placed upon clearly illustrating the principles of at least one embodiment.

DETAILED DESCRIPTION

Figure 1:
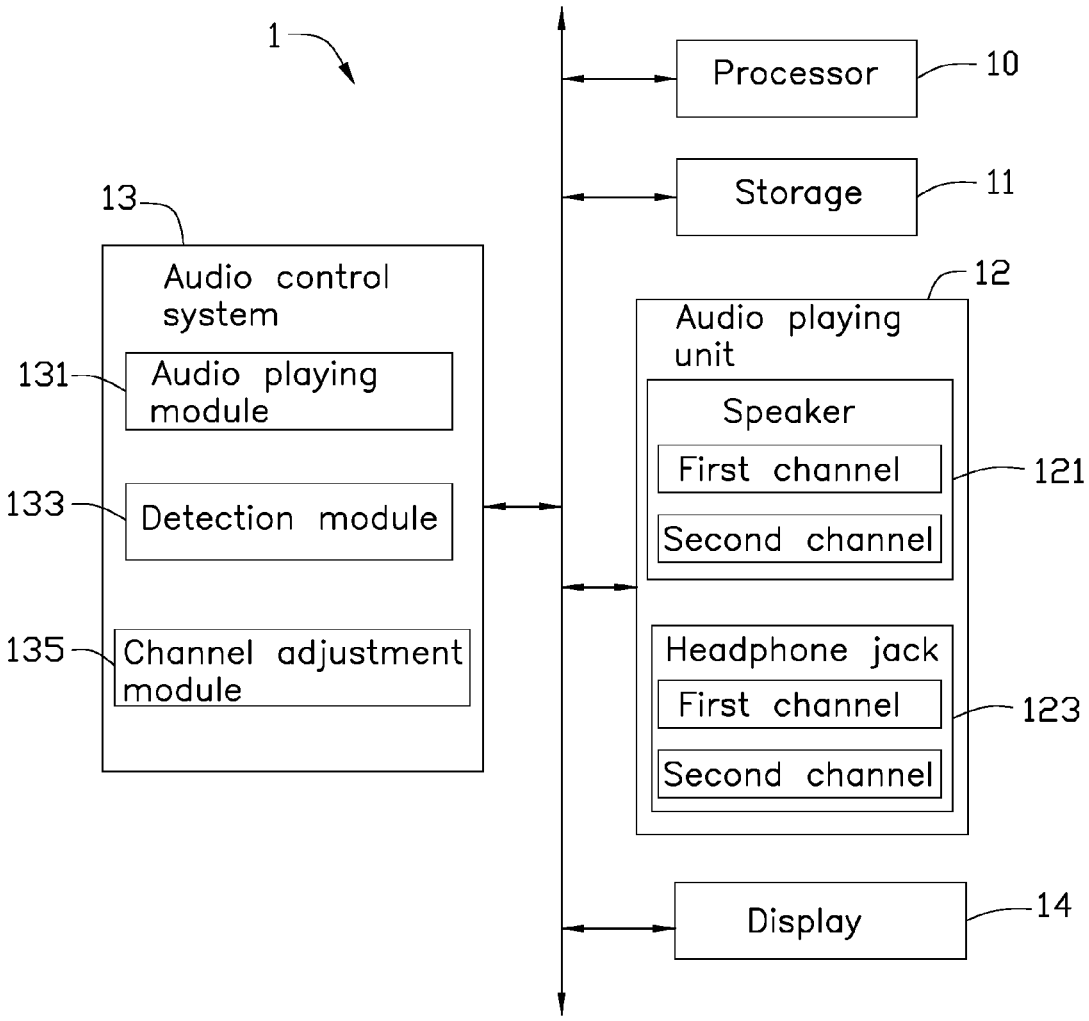
FIG. 1 is a schematic block diagram of an audio player according to an exemplary embodiment of the present disclosure.

Reference will be made to the drawing to describe various embodiments.

FIG. 1 illustrates a schematic block diagram of an audio player 1 according to an exemplary embodiment. The audio player 1 includes a processor 10, a storage 11, an audio playing unit 12, an audio control system 13, and a display 14. In the embodiment, the audio player 1 may be, for example, an MP3 player, a smart phone, a mobile internet device, a desktop computer, a portable computer, or other similar devices capable of playing audio signals. FIG. 1 shows one example of the audio player 1, and the audio player 1 can include more or fewer components than those shown in the embodiment, or have a different configuration of the components.

The audio control system 13 may include a plurality of software programs in the form of one or more computerized instructions stored in the storage 11 and executed by the processor 10 to perform operations of the audio player 1. The software programs of the audio control system 13 may be embedded in a device driver, such as a driver of a sound card, of the audio player 1. In the embodiment, the audio control system 13 includes an audio playing module 131, a detection module 133, and a channel adjustment module 135. In general, the word "module", as used herein, refers to logic embodied in hardware or firmware, or to a collection of software instructions, written in a programming language, such as, Java, C, or assembly. One or more software instructions in the modules may be embedded in firmware, such as in an erasable programmable read only memory (EPROM). The modules described herein may be implemented as either software and/or hardware modules and may be stored in any type of non-transitory computer-readable medium or other storage device. Some non-limiting examples of non-transitory computer-readable medium include CDs, DVDs, BLU-RAY, flash memory, and hard disk drives.

In the embodiment, the audio player 1 can play audio signals of various audio files having first channel signals and second channel signals, such as music and video files which are stored in the storage 11 or presented on the Internet. In the embodiment, the first channel signals have a first frequency and the second channel signals have a second frequency.

The audio playing unit 12 includes a speaker 121 and a headphone jack 123 configured for connecting a headphone. The speaker 121 and the headphone jack 123 both include a first channel and a second channel configured for outputting the first channel signals and the second channel signals, respectively.

The audio playing module 131 plays the audio files and outputs the audio signals through the audio playing unit 12. If the audio playing unit 12 plays the audio files, basic information of the audio files, such as attribute information (e.g., name of the audio files) is displayed on the display 14 by the audio playing module 131.

The detection module 133 detects whether the headphone is inserted in the headphone jack 123 when an audio file is played. When the headphone is not inserted in the headphone jack 123, the detection module 133 detects whether the first channel normally plays the first channel signals and the second channel normally plays the second channel signals. In one embodiment, the detection module 133 may detect whether audio signals (e.g., the first channel signals or the second channel signals) of the played audio file are output from the first and second channels by detecting whether the first channel and the second channel of the speaker 121 work normally. When one of the first and second channel signals is not played normally, the channel adjustment module 135 combines the channel signals (e.g., the first channel signals or the second channel signals) of one of the first and second channels which does not work normally to the channel signals of another of the first and second channels which works normally. For example, when the first channel signals are not normally played through the first channel but the second channel signals are normally played through the second channel, the channel adjustment module 135 combines the first channel signals to the second channel signals to form first combination signals and outputs the first combination signals through the second channel of the speaker 121. When the second channel signals are not normally played, but the first channel signals are normally played, the channel adjustment module 135 combines the second channel signals to the first channel signals to form second combination signals and outputs the second combination signals through the first channel of the speaker 121. In the embodiment, the channel adjustment module 135 may combine the first and second channel signals by modulating the first frequency of the first channel signals to the second frequency of the second channel signals, or by modulating the second frequency of the second channel signals to the first frequency of the first channel signals.

In addition, when one of the first channel and the second channel does not work normally, the detection module 133 displays a notification message on the display 14 to notify the user that the first or second channel does not work normally. Thus, the user can process the malfunction of the first or second channel according to the notification message.

If the headphone is inserted in the headphone jack 123, the detection module 133 detects whether the first channel signals and the second channel signals are normally played through the first channel and the second channel of the headphone. If the first channel signals are not normally played through the first channel of the headphone, but the second channel signals are normally played through the second channel of the headphone, the channel adjustment module 135 combines the first channel signals to the second channel signals to form the first combination signals and outputs the first combination signals through the second channel of the headphone. If the second channel signals are not normally played by the second channel of the headphone, but the first channel signals are normally played by the first channel of the headphone, the channel adjustment module 135 combines the second channel signals to the first channel signals to form the second combination signals and outputs the second combination signals through the first channel of the headphone.

In other embodiments, the headphone jack 123 of the audio playing unit 12 can be omitted and the audio playing unit 12 only includes the speaker 121, or the speaker 121 can be omitted and the audio playing unit 12 only includes the headphone jack 123.

In another embodiment, the display 14 may be a touch screen, when the audio playing unit 12 plays the audio files, the touch screen displays a first icon and a second icon. When the first icon is touched, the channel adjustment module 135 is triggered and combines the first channel signals to the second channel signals to form the first combination signals. When the second icon is touched, the channel adjustment module 135 is triggered and combines the second channel signals to the first channel signals to form the second combination signals. When the first icon or second icon is touched again, the audio playing unit 12 plays the first channel signals through the first channel and plays the second channel signals through the second channel, as usual.

In another embodiment, the audio player 1 may include two volume control buttons including a volume up button and a volume down button. If the volume up button is pressed for a predetermined time period (e.g., three or five seconds), the channel adjustment module 135 is triggered and combines the first channel signals to the second channel signals to form the first combination signals. When the volume down button is pressed for the predetermined time period, the channel adjustment module 135 is triggered and combines the second channel signals to the first channel signals to form the second combination signals. When the volume up button or the volume down button is pressed for the predetermined time period again, the audio playing unit 12 plays the first channel signals through first channel and the second channel signals through the second channel, respectively, as usual.

Figure 2:
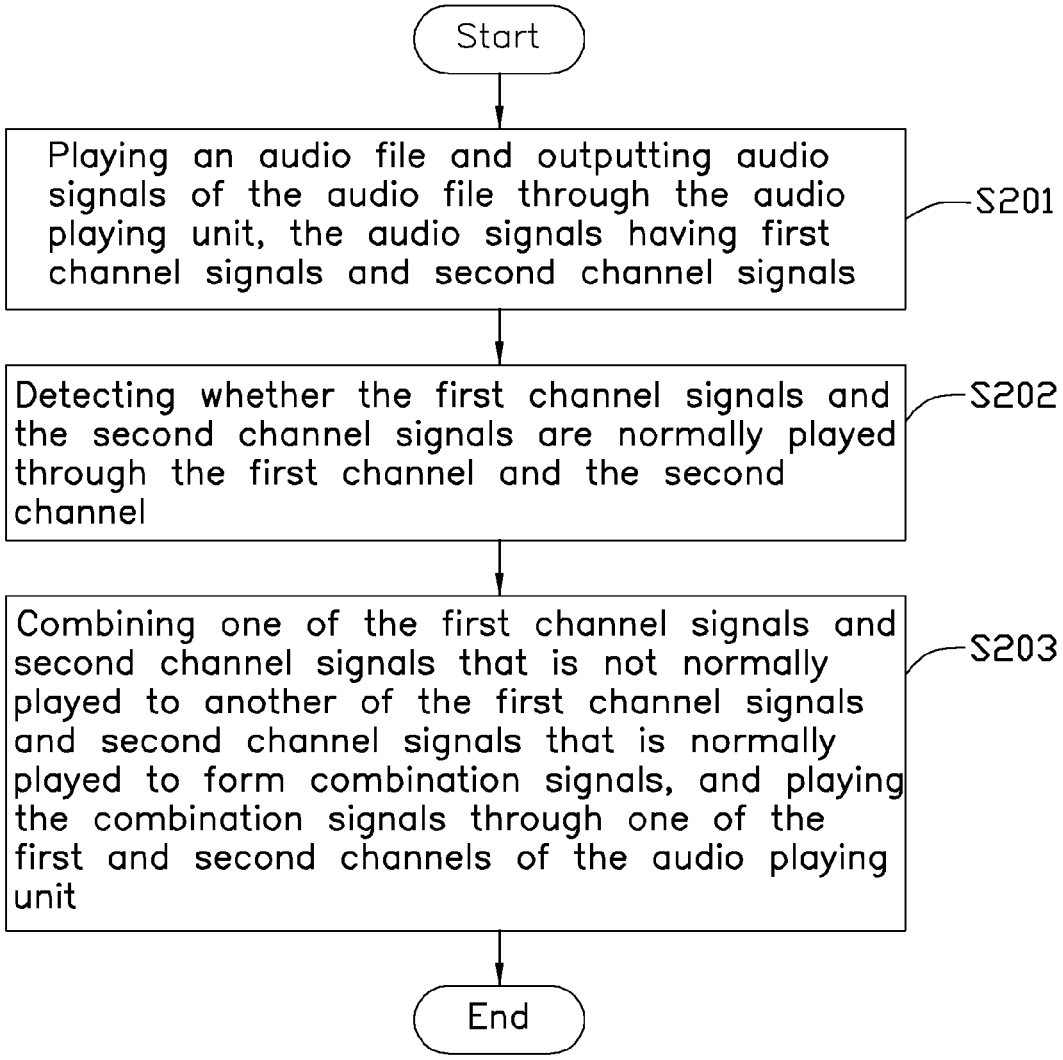
FIG. 2 is a flowchart of one embodiment of an audio control method implemented by the audio player of FIG. 1.

FIG. 2 is a flowchart showing an audio control method implemented by the audio player 1 of FIG. 1. The method includes the following steps, but it should be understood that in other embodiments, additional steps may be added, others deleted, and the ordering of the steps may be changed.

In step S201, the audio playing module 131 plays an audio file, and outputs audio signals of the audio file through the audio playing unit 12, the audio signals have first channel signals and second channel signals. The audio file may be music or video, which is stored in the storage 11 or presented on the Internet.

In step S202, the detection module 133 detects whether the first channel signals and the second channel signals are normally played through the first channel and the second channel of the speaker or the headphone, respectively.

If one of the first channel signals and the second channel signals is not normally output through the corresponding channel, in step S203, the channel adjustment module 135 combines one of the first and second channel signals (e.g., the first channel signals) to another (e.g., the second channel signals) to form combination signals. In addition, the audio playing unit 12 plays the combination signals through the first or the second channel. In the embodiment, when the first channel signal is not normally played through the first channel, the channel adjustment module 135 combines the first channel signals to the second channel signals to form the first combination signals. When the second channel signals are not normally played through the second channel, the channel adjustment module 135 combines the second channel signals to the first channel signals to form the second combination signals. Thereupon, the first combination signals or the second combination signals are played through the second channel or the first channel, correspondingly.

In addition, when the first channel signals and the second channel signals are both normally played, the channel adjustment module 135 may be triggered by the first and second icons or the volume control buttons to perform the signal combining process as described in step S203. Details of triggering the adjustment module 135 are provided hereinbefore.

In summary, the audio control method and the audio player 1 implemented method combines the first channel signals and the second channel signals to play the audio signals normally when any of the first channel signals and the second channel signals are not normally played. Furthermore, in particular situations, such as when user is crossing the road, the audio player 1 can be controlled to overlay one of the first channel signals and the second channel signals to another, and plays the combination signals only through one of the first and second channels of the headphone. Thus, acoustical enjoyment is improved.

It is to be understood that even though numerous characteristics and advantages of the present embodiments have been set forth in the foregoing description, together with details of the structures and functions of the embodiments, the disclosure is illustrative only; and changes may be made in detail, especially in the matters of arrangement of parts within the principles of the embodiments, to the full extent indicated by the broad general meaning of the terms in which the appended claims are expressed.

What is claimed is:

1. An audio player, comprising:

a storage;

a processor;

a volume up button and a volume down button;

an audio playing unit having a first channel and a second channel; and one or more programs stored in the storage and executed by the processor, the one or more programs comprising:

an audio playing module playing an audio file and outputting audio signals of the audio file through the audio playing unit, the audio signals having first channel signals and second channel signals;

a detection module detecting whether the first channel signals and the second channel signals are normally played through the first channel and the second channel, respectively; and a channel adjustment module combining one of the first channel signals and second channel signals that is not normally played to another of the first channel signals and second channel signals that is normally played to form combination signals, and playing the combination signals through one of the first and second channels of the audio playing unit, when one of the first channel signals and the second channel signals are not normally played; the channel adjustment module also triggered and combining the first channel signals to the second channel signals to form first combination signals when the volume up button is pressed for a predetermined time period, and the channel adjustment module triggered and combining the second channel signals to the first channel signals to form second combination signals when the volume down button is pressed for the predetermined time period.

2. The audio player of claim 1, wherein the audio playing unit comprises a speaker having the first channel to play the first channel signals and the second channel to play the second channel signals.

3. The audio player of claim 1, wherein the audio playing unit comprises a headphone jack having the first channel to play the first channel signals and the second channel to play the second channel signals.

4. The audio player of claim 1, wherein the detection module detects whether the first channel signals and the second channel signals are normally played by detecting whether the first channel signals are output through the first channel and whether the second channel signals are output through the second channel.

5. The audio player of claim 1, wherein the channel adjustment module combines the first channel signals to the second channel signals to form first combination signals, and plays the first combination signals through the second channel, when the first channel signals are not normally played.

6. The audio player of claim 1, wherein the channel adjustment module combines the second channel signals to the first channel signals to form second combination signals and plays the second combination signals through the first channel, when the second channel signals are not normally played.

7. The audio player of claim 1, wherein the audio player further comprises a display, and the detection module further displays a notification message on the display to notify a user that the first or second channel does not work normally.

8. The audio player of claim 7, wherein the display is a touch screen displaying a first icon and a second icon, the channel adjustment module is triggered and combines the first channel signals to the second channel signals to form first combination signals, when the first icon is touched, and the channel adjustment module is triggered and combines the second channel signals to the first channel signals to form second combination signals, when the second icon is touched.

9. An audio control method of an audio player having an audio playing unit and comprising a volume up button and a volume down button, the audio playing unit having a first channel and a second channel to output audio signals, the method comprising:

playing an audio file and outputting audio signals of the audio file through the audio playing unit, the audio signals having first channel signals and second channel signals;

detecting whether the first channel signals and the second channel signals are normally played through the first channel and the second channel, respectively;

combining one of the first channel signals and second channel signals that is not normally played to another of the first channel signals and second channel signals that is normally played to form combination signals, when one of the first channel signals and the second channel signals are not normally played;

combining the first channel signals to the second channel signals to form first combination signals and playing the first combination signals through the second channel, when the volume up button is pressed for a predetermined time period;

combining the second channel signals to the first channel signals to form second combination signals and playing the second combination signals through the first channel, when the volume down button is pressed for the predetermined time period; and playing the combination signals through one of the first channel and the second channel of the audio playing unit.

10. The method of claim 9, wherein the audio playing unit comprises a speaker having the first channel to play the first channel signals and the second channel to play the second channel signals.

11. The method of claim 9, wherein the audio playing unit comprises a headphone jack having the first channel to play the first channel signals and the second channel to play the second channel signals.

12. The method of claim 9, wherein the detecting step comprises:

detecting whether the first channel signals and the second channel signals are normally played by detecting whether the first channel signals are output through the first channel and whether the second channel signals are output through the second channel.

13. The method of claim 9, wherein the combining step comprises:

combining the first channel signals to the second channel signals to form first combination signals, and playing the first combination signals through the second channel, when the first channel signals are not normally played through the first channel.

14. The method of claim 9, wherein the combining step comprises:

combining the second channel signals to the first channel signals to form second combination signals, and playing the second combination signals through the first channel, when the second channel signals are not normally played through the second channel.

15. The method of claim 9, wherein the detecting step comprises:

displaying a notification message on a display of the audio player to notify a user that the first or second channel does not work normally.

16. The method of claim 15, wherein the display is a touch screen displaying a first icon and a second icon, and the combining step comprises:

combining the first channel signals to the second channel signals to form first combination signals and playing the first combination signals through the second channel, when the first icon is touched; and combining the second channel signals to the first channel signals to form second combination signals and playing the second combination signals through the first channel, when the second icon is touched.

* * * * *